US005386205A

United States Patent [19]

Burt et al.

[11] Patent Number: 5,386,205

[45] Date of Patent: Jan. 31, 1995

[54] HIGH IMPACT ELECTRO PRESS

[75] Inventors: William C. Burt, 1711 S. Extension Rd., #1039, Mesa, Ariz. 85210; Winfield W. Salisbury, Sun City, Ariz.

[73] Assignee: William C. Burt, Mesa, Ariz.

[21] Appl. No.: 911,027

[22] Filed: Jul. 9, 1992

[51] Int. Cl.[6] ..... H01F 3/00

[52] U.S. Cl. ..... 335/255; 100/917

[58] Field of Search ..... 335/255, 258, 260, 261; 100/917

[56] References Cited

U.S. PATENT DOCUMENTS

| | | | |
|---|---|---|---|
| 3,709,083 | 1/1973 | Doherty | 318/119 |
| 4,628,809 | 12/1986 | Das et al. | 100/208 |
| 5,113,736 | 5/1992 | Meyerle | 100/917 |

*Primary Examiner*—Lincoln Donovan
*Attorney, Agent, or Firm*—Gregory J. Nelson

[57] ABSTRACT

An improvement to an electro-magnetically actuated piston has a first magnetic core and a second magnetic core. There is an electro-magnet coil for magnetically coupling the first and the second magnetic cores. The coil moves the first and second magnetic cores relatively, one to another. In the improvement itself the first and the second magnetic cores each comprise non-conductive core material or an array of a multiplicity of lamination plates. The non-conductive core material or each of the lamination plates are configured to receive a portion of the electro-magnet coil. The nonconductive core material or array of lamination plates encloses the coil and contains the magnetic field produced by the coil when the coil is energized. When the non-conductive core material or lamination plates of the first and second magnetic cores are in juxtaposition, the result is to generally isolate any magnetic materials adjacent the lamination plates from the magnetic flux produced when the coil is energized.

11 Claims, 3 Drawing Sheets

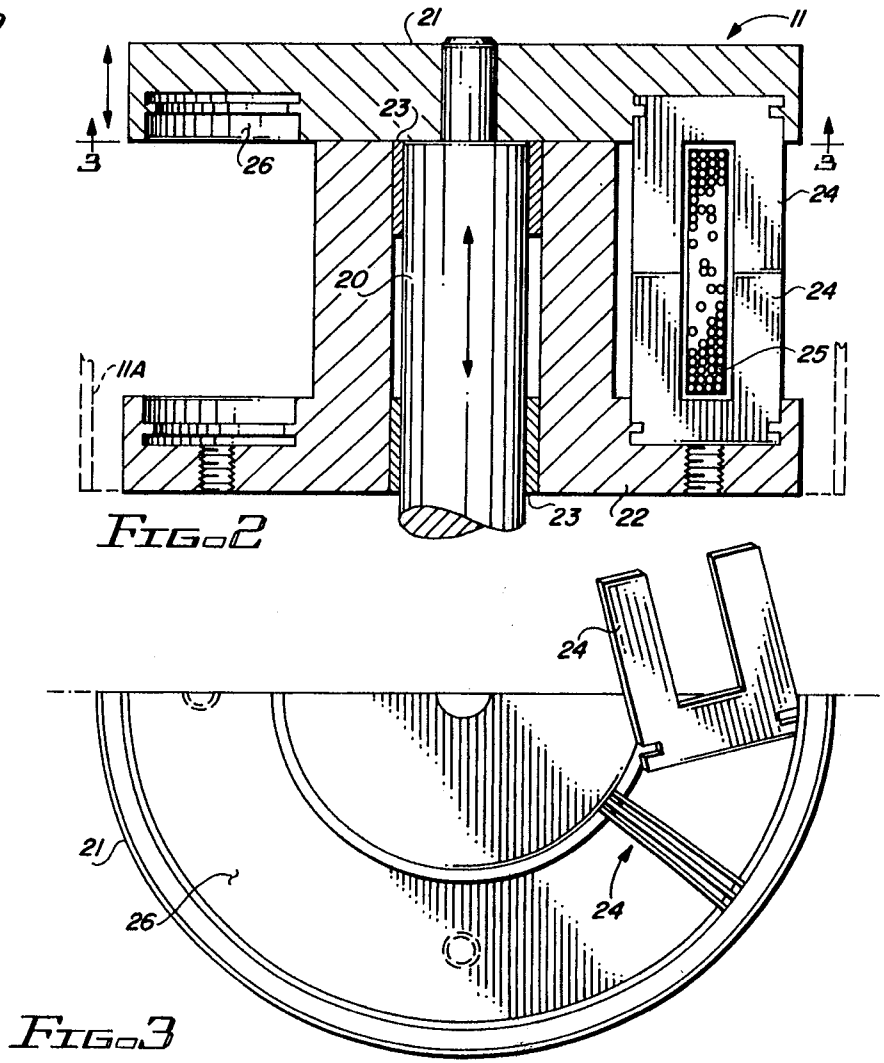
FIG. 2
FIG. 3
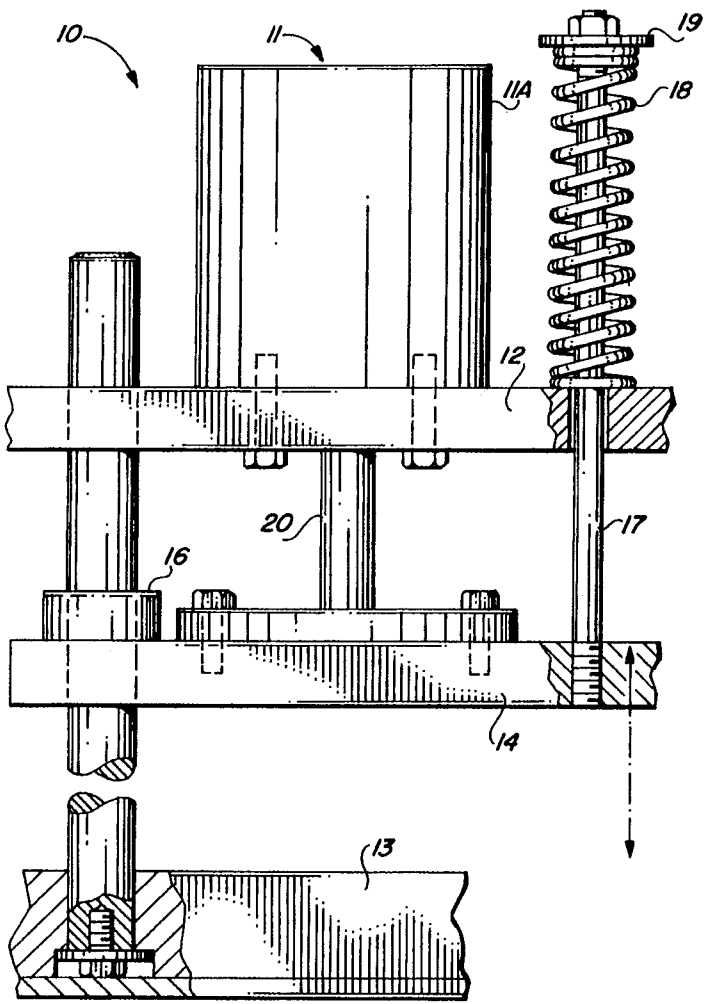
FIG. 1

HIGH IMPACT ELECTRO PRESS

BACKGROUND

1. Technical Field of the Invention

The invention relates to punch presses wherein an electro-magnetic driving force is employed. In particular, the invention relates to means for achieving a maximum magnetic driving force by the time the moving elements of the press are put into motion.

2. Prior Background Art

Electro-magnetic punch presses are well known. Unfortunately, all known punch presses of this type suffer a common fault. That fault lies in the fact that the moving elements of the press are induced to move by the magnetic field before the magnetic core is fully magnetized and the magnetic field has reached its peak energy level. Thus, the punch elements are induced to move in a relatively sluggish manner. Since force is determined by the mass and the acceleration provided that mass, it may be readily realized that the faster the punch elements are accelerated, the greater the force applied by the punch.

Several factors influence the ability to rapidly accelerate the punch elements. In the prior art much of the machine itself forms part of the magnetic path through which the energy passes in energizing the punch coil. This dilutes the energy which is best isolated to the electro-magnetic coil itself. Further the faster the rise time of the electro-magnetic energization pulse, the less the depth of the core material which is utilized to immediately drive the magnetically driven element.

It is an objective of the present invention to more fully isolate the magnetic field than has been achieved in prior art devices. Most importantly is an objective of the invention that the adverse ramifications of skin effect will be avoided such that a rapidly rising energization pulse may be employed and permit the full depth penetration of the magnetic's core by the electro-magnetic wave thereby generated.

SUMMARY DESCRIPTION OF THE INVENTION

The invention may be summarized as an electro-magnetically actuated piston. There is a first annular structure of non-conductive core material, or a multiplicity of lamination plates, defining a first magnetic core. A second annular structure of non-conductive core material, or a multiplicity of lamination plates, defines a second magnetic core. An electro-magnet coil is magnetically coupled to the first and the second magnetic cores to move the first magnetic core relative to the second magnetic core when the coil is energized.

The non-conductive core material or multiplicity of lamination plates is configured to generally enclose the coil when the first and the second magnetic cores move into juxtaposition. In this way, a closed magnetic field, generally restricted to the non-conductive material or the multiplicity of the laminations, is produced when the first and the second magnet cores are in juxtaposition and the coil is energized.

In a presently preferred embodiment, a multiplicity of lamination plates defining the first and the second magnetic cores comprise U-shaped, transformer lamination plates.

The piston also includes a base. Support means are coupled to the base and to the first magnetic core for fixedly supporting the first magnetic core adjacent the base. A piston rod is slidingly coupled to the first magnetic core. A first end of the piston rod coupled to the second magnetic core for movement with the second magnetic core when second magnetic core moves relative to the first magnetic core when the coil is energized. The piston rod supports the second magnetic core adjacent the first magnetic core.

The invention is disclosed as an improvement to an electro-magnetically actuated piston comprising a first magnetic core and a second magnetic core. There is an electromagnet coil for magnetically coupling the first and the second magnetic cores. The coil moves the first and second magnetic cores relatively, one to another.. In the improvement itself the first and the second magnetic cores each comprise non-conductive core material or an array of a multiplicity of lamination plates.

The non-conductive core material or each of the lamination plates are configured to receive a portion of the electro-magnet coil. The non-conductive core material or array of lamination plates encloses the coil and contains the magnetic field produced by the coil when the coil is energized. When the non-conductive core material or lamination plates of the first and second magnetic cores are in juxtaposition, the result is to generally isolate any magnetic materials adjacent the lamination plates from the magnetic flux produced when the coil is energized.

BRIEF DESCRIPTION OF THE DRAWINGS

FIG. 1 is a side elevational view of a portion of an electro press energized by the quick reacting electro-magnet disclosed herein.

FIG. 2 is a cross-sectional, side elevational view of the electro-magnetic piston and piston rod. To the right of the illustration, the electro-magnetic coils and laminations are shown. To the left of the illustration are the general machining contours of the elements shown prior to installation of the coils and laminations.

FIG. 3 is a partial plan view taken along line 3—3 of FIG. 2. Also illustrated is the manner in which the electro-magnetic coil lamination is inserted into the contoured machining of the plate.

DETAILS OF BEST MODE FOR CARRYING OUT THE INVENTION

Figure 4:
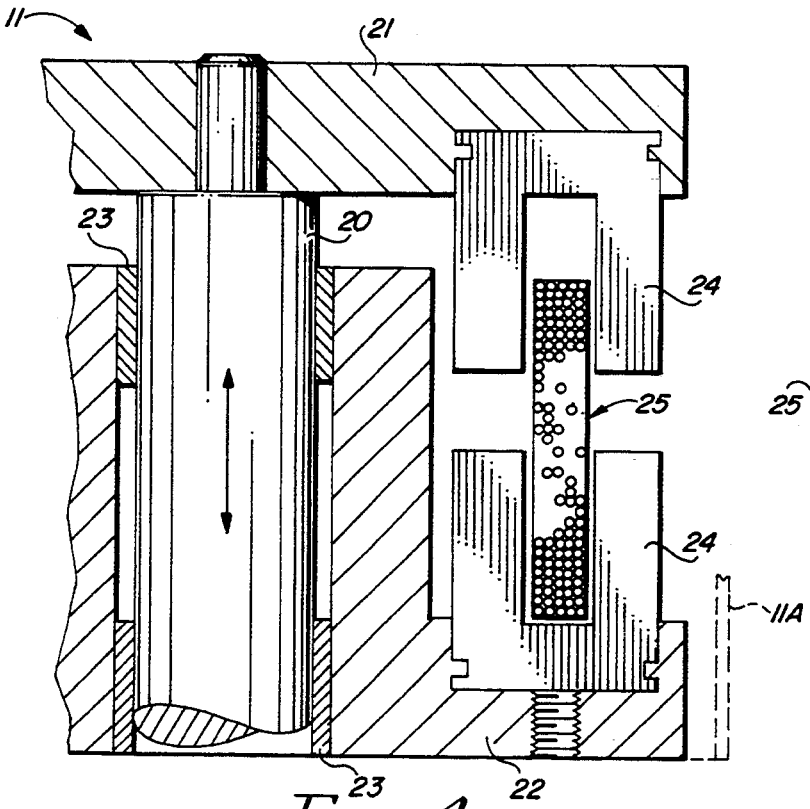
FIG. 4 is a partial cross-sectional elevational view of the nominal disposition of the electro-magnetic piston prior to energization of the coil. A single unitary coil winding is utilized. The upper set of coil laminations moves with respect to the coil winding.

For purposes of promoting an understanding of the principles of the invention, reference will now be made to the embodiments illustrated in the drawings and specific language will be used to describe same. It will nevertheless be understood that no limitation of the scope of the invention is thereby intended. Alterations and modifications of the illustrated device are contemplated, as are such further applications of the principles of the invention as would normally occur to one skilled in the art to which the invention pertains.

FIG. 1 illustrates a side elevational view of the High Impact Electro Press to be disclosed in greater detail in the discussion which follows and the accompanying drawings. Items which are normally duplicated in producing a press are not repetitively in FIG. 1. These include the leader pins which guide the motion of moving plates and springs which return the moving parts to their nominal resting position.

Electro press 10 has an electro-magnetic piston 11, shown here housed within an outer casing 11A. Piston 11 is mounted on a fixed base 12 which is supported by one of a plurality of leader pins 15. Only one leader pin is shown.

A piston rod 20 exits piston 11 and passes freely through base 12 to be coupled to punch plate 14 which moves up and down with piston rod 20 as piston 11 is actuated.

A punch base 13 supports the unit and provides a work surface upon which an item is placed to be subjected to the impact provided by punch plate 14. To assure that punch plate 14 always travels with its lower surface parallel to the upper surface of punch base 13, punch plate 14 is slidingly coupled to leader pins 15. Bearings 16 provide a precision fit with the surface of leader pins 15 and, since at least four such leader pins are generally employed in the art, twisting of punch plate 14 as it travels is avoided.

A spring-compressing rod 17 is fastened to punch plate 14. Rod 17 passes freely through piston base 12. A coil spring 18 is fitted over the upper end of spring-compressing rod 17 and a cap 19 is maintained in position there. When punch plate 14 is driven downward by motion of piston rod 20, spring-compression rod 17 will travel downward as well. This downward motion of rod 17 causes cap 19 to compress spring 18 between cap 19 and fixed base 12. When the electro-magnetic energy which originally caused the displacement of piston rod 20 is removed, spring 18 returns to its nominal position drawing punch plate 14 upwards and returning piston rod 20 to its nominal resting position. As with leader pins 15, a plurality of spring-compression rods 17 and springs 18 are generally utilized in electro-presses so as to exert a uniform lifting force on punch plate 14.

As those who are familiar with the transmission of high frequency energy are aware, the higher the frequency, the less the cross-sectional area of a given conductor is utilized in the transmission of the energy. Eventually a frequency is reached where most of the energy is traveling along the peripheral, annular cross-section of a conductor. This phenomenon is known as skin effect. As less of the conductor is employed in the transfer of energy, higher losses result. Recognition of skin effect led experimenters to the development of coaxial cables and wave guides.

There is an analogous effect with respect to the creation of electro-magnetic fields. To achieve a high impact with an electro-magnetic punch, one seeks to rapidly accelerate the mass of the piston and punch plate assembly in order to achieve the greatest impact. Thus, one seeks to create an instantaneous magnetic field to launch the piston rod and punch plate on its travels. Unfortunately all of the magnetic materials comprising the electro punch typically form part of the magnetic path for the flux. The maximum magnetic field is not achieved until all of this extraneous magnetic material has become saturated. The effect is illustrated by the typical hysteresis curve produced when a fast rising transient is used to energize the magnetic circuit.

A metal forming or metal cutting punch operated directly by magnetic force must meet certain requirements of energy efficiency and rapidity of operation to be a practical, commercially competitive machine. These requirements can only be met if the magnetic force is established within a short time after operation is initiated. This assumes that the maximum force will be fully established by the time the moving punch or die elements develop appreciable motion.

Energy is given as force multiplied by distance moved during action. (E=FD) Thus, an efficient magnetic force for a punch operation must reach its peak value very quickly, in milliseconds or less. Assume the magnetic material (such as silicon steel laminations) has a finite electrical conductivity. Then the charging magnetic field necessary to establish magnetic force will act like an electro-magnetic wave in the magnetic material: the more rapid the onset of this wave, the less will be its penetration into the magnetic material. As already noted, this effect is frequently called skin effect.

Skin effect dictates the requirement that magnetic material, if it is electrically conductive, must consist of an assembly of thin plates, called "laminations." Laminations allow magnetic force to penetrate to a significant depth within the magnetic material in relatively short time when compared to a non-laminated conductor magnetically driven to achieve mechanical force and motion.

The skin depth of magnetic action is given by the formula $\delta=1/\sqrt{\pi f \mu \sigma}$, where f is the frequency of current as related to its initial rise time. Pi is the familiar constant. Mu is the magnetic permeability of the magnetic material. Sigma is electrical conductivity of the material. This equation shows that a large permeability, such as found in silicon steel, will cause a correspondingly shallow skin depth. Whereas, low electrical conductivity will produce a deeper skin depth.

Note that if the conductivity is reduced to zero, as in ceramic insulator which may be magnetic, then skin depth can become very large and its effects may be neglected.

In a rapid acting, magnetic force system, it is thus seen necessary to have either very thin magnetic laminations insulated electrically from each other, or a magnetic material of zero electric conductivity. A zero-conductivity magnetic material may consist of a magnetic iron oxide ceramic, such as a ferrite, or a powdered iron material in which the iron particles are coated, as with epoxy, so as to be not electrically conductive in the aggregate.

FIG. 2 is a cross-sectional view of the elements of electro-magnetic piston 11. A portion of the outer casing 11A is indicated by a phantom outline. Piston rod 20 is coupled to a piston platten 21 which will move in response to electro-magnetic energy created by current passing through coil 25, seen at the right hand of side of FIG. 2. It will be understood coil 25 completely encircles piston rod 20. However, on the left side of the illustration of FIG. 2, coil 25 is not illustrated in order that the manner in which elements 21 and 22 are machined to accept transformer lamination plates 24 may be shown more clearly. The use of transformer laminations plates is presented for exemplary purposes. A core made, instead, of a non-conductive material also constitutes a preferred embodiment of the invention in accord with the earlier discussion concerning skin effect and its detriments.

A plan view of piston plate 21, taken along line 3—3 of FIG. 2 is shown in FIG. 3. Here a transformer lamination 24 is drawn in perspective to indicate the manner in which individual transformer laminations are locked within the machined configurations which create the cavity 26. Lamination 24 is inserted across the width of cavity 26 and twisted slightly to lock the lamination in position as indicated in FIG. 2. Several laminations 24 already in position are shown in FIG. 3. In practice, the entire cavity 26 will be filled with laminations 24 arrayed in the manner nominally indicated in FIG. 3.

In assembling the piston 11 shown in FIG. 2, piston rod 20 is first passed through the piston rod guide base 22. Piston rod bearings 23 ease the passage of piston rod 20 through guide base 22. Piston rod 20 is then affixed to piston plate 21.

Piston guide 22 is configured in the same manner as is piston plate 21 so as to accept transformer lamination plates 24. These are installed in the same manner earlier discussed with respect to FIG. 3. Coil 25 may be wound as a preform and deposited within transformer lamination plates 24 in piston rod guide 22. A potting material which is an effective conductor of heat may be utilized to retain coil 25 within laminations 24 in guide 22.

It should be noted that in the illustration of FIG. 2 rod 20 has already been driven downward by actuation of coil 25. This has drawn piston platten downward as well and brought laminations 24 in platten 21 into juxtaposition with the laminations 24 in guide 22 closing the magnetic circuit.

Two important effects are achieved in the structure illustrated in FIGS. 2 and 3. The use of a multiplicity of transformer lamination plates rapidly magnetizes each individual lamination plate creating a very fast rising electro-magnetic field. This is analogous to the use of an electrical conductor made up of many fine wires to overcome the adverse performance imposed by skin effect. The same result accrues when the core is made of a non-conductive material.

A second favorable response is the closure of the magnetic circuit when laminates 24 in platten 21 and guide 22 come into juxtaposition. The magnetic circuit is then instantly closed and the remaining parts and pieces of the electro press no longer form a significant part of the electro-magnetic path. Thus, the electro-magnetic field is not only fast rising but it is concentrated.

Figure 4A:
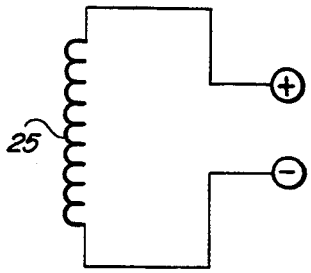
FIG. 4A shows the unitary coil winding in schematic fashion.

When the current is withdrawn from coil 25, springs 18, shown in FIG. 1, draw piston rod 20 upward, moving platten 21 and its laminations 24 away from guide 22 and its laminations. The result is shown in the illustration of FIG. 4. Coil 25 is shown schematically is FIG. 4A. When a transient impulse similar to the one illustrated in FIG. 4B is applied across coil 25, the multiplicity of laminations 24 will be quickly saturated by the magnetic flux, rapidly drawing piston platten 21 downward, driving piston rod 20 downward as well.

Figure 5:
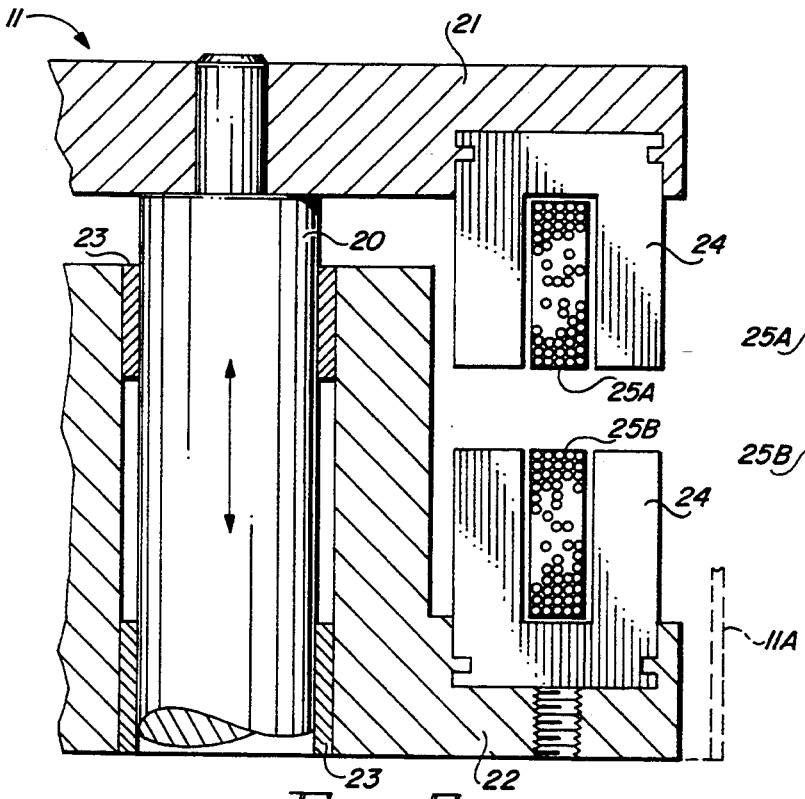
FIG. 5 is similar to the illustration of the FIG. 4 with the exception that the electro-magnetic coil is wound in two individual sections which move with respect to each other as the electro-magnetic piston moves.
Figure 5A:
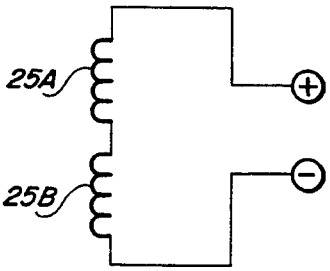
FIG. 5A is a schematic representation of the two individual electro-magnetic coils of FIG. 5.
Figure 6:
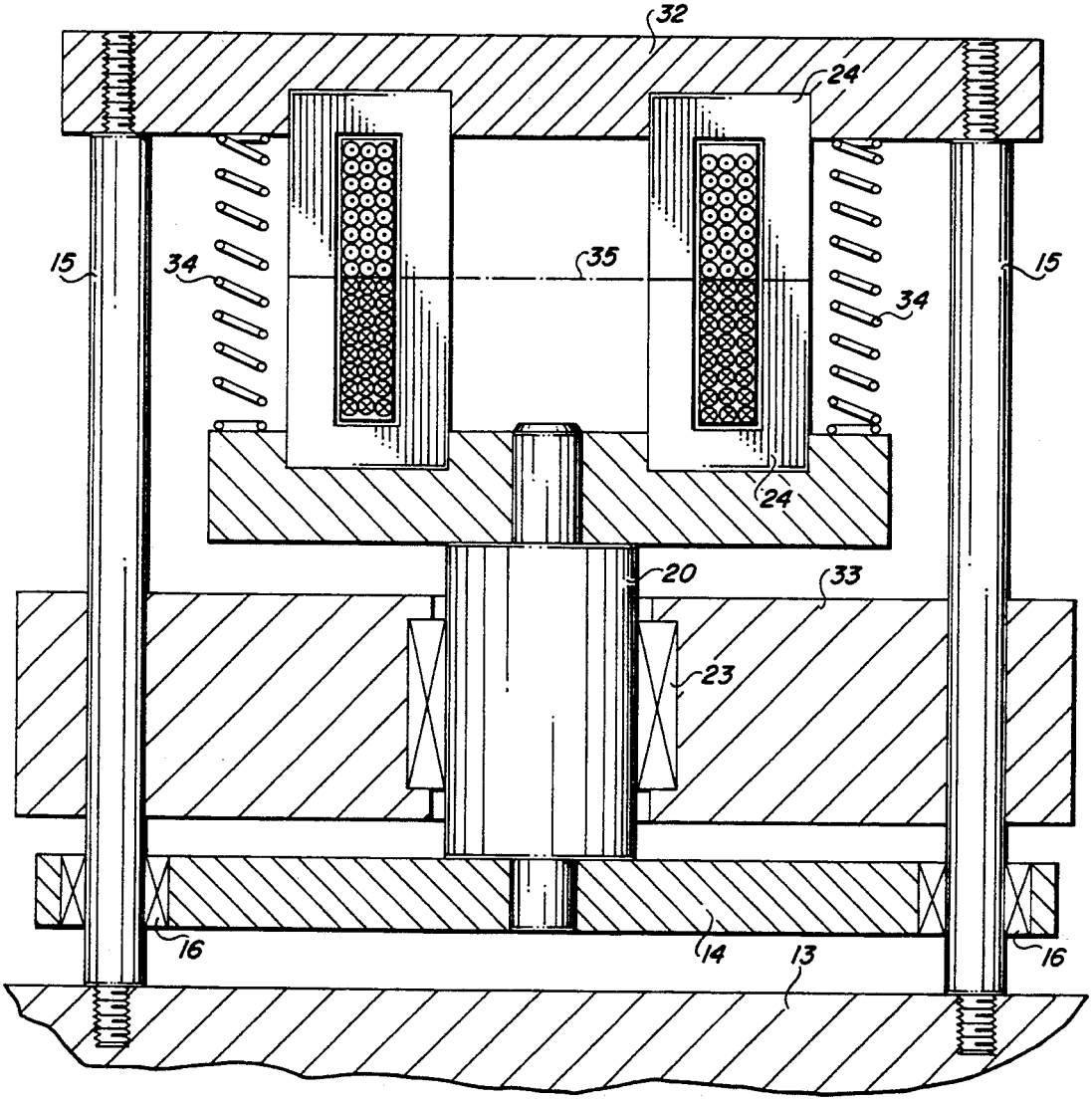
FIG. 6 is a partial cross-sectional elevational view of the nominal disposition of the electro-magnetic pistons prior to energization of the coils.
Figure 6A:
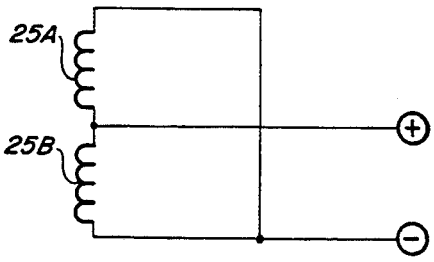
FIG. 6A is a schematic representation of the electro-magnetic coils of FIG. 6.

An alternative embodiment of the invention is shown in FIG. 5 wherein coil 25 comprises two separable coil sections 25A and 25B. These coils are shown schematically in FIG. 5A.

This structure represents an improvement over that of FIG. 4 in that the laminations 24 and piston platten 21 never move away from the electro-magnetic coil. The laminations 24 and piston platten 21 will therefore saturate faster than in the embodiment of FIG. 4. A more powerful magnet is thus achieved and the attraction forces between the upper laminations in platten 21 and the lower laminations in guide 22 are significantly increased with a resulting increase in the impact delivered via piston rod 20.

An embodiment of the invention was conceived in which the two coil sections 25A and 25B with their associated laminations were closed and in intimate juxtaposition at the instant the energy was applied to the coils. This embodiment required coils 25A and 25B to be wired such that their magnetic fields were in opposition. Magnetic repulsion would drive the coils apart. Analysis indicates, however, that the self inductance of their circuit would be too large to allow a rapid build up of the magnetic field needed to provide a high impact piston motion.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such clear and concise manner that those skilled in the art may readily understand and practice the invention.

That which is claimed is:

1. An electro-magnetically actuated press having:

(a) a piston axially reciprocable between a first inoperative and second operative position;

(b) a first magnetic core formed as a multiplicity of plates arranged in a generally annular array about the axis of said piston;

(c) a second magnetic core formed as a multiplicity of plates arranged in a generally annular array about the axis of the piston;

(d) one of said cores being coupled to said piston;

(e) an electro-magnet coil magnetically coupled to said first and said second magnetic cores whereby energization of said coil causes said piston to move from said first to said second position; and (f) said at least one of said cores being configured to generally enclose said coil when said piston moves to said second position producing a closed magnetic field, having increased flux area within the cores.

2. The press of claim 1 wherein said plates defining said first and said second magnetic cores are U-shaped.

3. The press of claim 1 wherein said plates defining said first and second magnetic cores are transformer lamination plates.

4. The press of claim 1 further including support means for fixedly supporting said first magnetic cores, a piston rod carried on said piston slidable relative to said first magnetic core, said piston rod having a first end and a second end, said first end of said piston rod coupled to said second magnetic core for movement with said second magnetic core when said coil is energized.

5. The press of claim 1 further including return means for returning said piston to said first position upon de-energization of said coil.

6. The press of claim 4 wherein said plates are mechanically detachably coupled to said piston and said support means.

7. In an electro-magnetically actuated press comprising a first magnetic core and a second magnetic core with an electro-magnet coil for magnetically coupling said first and said second magnetic cores to move said first and second magnetic cores relative to one another to cause a piston to move to an operative position, the improvement comprising:

(a) said first and said second magnetic cores each comprised of an array of a multiplicity of plates arranged about said piston;

(b) at least one of said cores having a recess configured to receive at least a portion of said electro-magnet coil;

(c) said cores enclosing said coil when said coil is energized and first and said second magnetic cores are in juxtaposition, thereby generally isolating the magnetic field to the cores and increasing the effective magnetic flux area.

8. The piston of claim 7 wherein said coil comprises two separate sections each associated with one of said cores.

9. The press of claim 7 wherein said plates are transformer lamination plates.

10. The press of claim 7 wherein said plates are non-conductive material.

11. An electro-magnetically actuated press comprising:

(a) a piston having a rod and being reciprocable between a first inoperative and second operative position;

(b) a first stationary core formed as a multiplicity of thin generally U-shaped plates arranged in a generally annular array about said piston defining an annular recess;

(c) a second moveable core formed as a multiplicity of thin generally U-shaped plates arranged in a generally annular array bout said piston above said first core and defining an annular recess, said second core being secured to said piston;

(d) an electro-magnetic coil secured within the annular recess of said first core; and (e) whereby upon energization of said coil said piston is moved to said second operative position with the coil substantially enclosed within the recesses of said first and second cores and whereby the magnetic wave penetrates the plates increasing the magnetic flux area.

* * * * *